US007131647B1

(12) United States Patent
Bachlor

(10) Patent No.: US 7,131,647 B1
(45) Date of Patent: Nov. 7, 2006

(54) CASINO PINBALL GAME

(76) Inventor: Levy Bachlor, 2307 Fitzwater St., Philadelphia, PA (US) 19146

( * ) Notice: Subject to any disclaimer, the term of this patent is extended or adjusted under 35 U.S.C. 154(b) by 75 days.

(21) Appl. No.: 10/992,551

(22) Filed: Nov. 18, 2004

(51) Int. Cl.
*A63F 7/02* (2006.01)

(52) U.S. Cl. ..... 273/108; 273/118 R; 273/118 A; 273/119 R; 273/119 A; 273/138.1; 273/143 R

(58) Field of Classification Search ..... 273/118 R, 273/118 A, 118 D, 119 R, 119 A, 121 R, 273/121 A, 138.1, 143 R, 108
See application file for complete search history.

(56) References Cited

U.S. PATENT DOCUMENTS 3,853,318 A * 12/1974 Cagan ..... 273/379
4,380,335 A * 4/1983 Chaudhry et al. ..... 273/121 A
4,508,345 A * 4/1985 Okada ..... 273/143 R
5,342,049 A * 8/1994 Wichinsky et al. ..... 273/119 R
5,356,141 A * 10/1994 Oursler et al. ..... 273/119 R
5,785,594 A 7/1998 Seibert, Jr.
5,882,261 A * 3/1999 Adams ..... 463/20
6,047,963 A * 4/2000 Pierce et al. ..... 273/121 B
6,203,008 B1 * 3/2001 Krise et al. ..... 273/121 B
6,340,158 B1 1/2002 Pierce
6,358,146 B1 3/2002 Adams
2002/0066996 A1 * 6/2002 Nelson et al. ..... 273/118 R
2004/0222585 A1 * 11/2004 Moffett et al. ..... 273/118 R

FOREIGN PATENT DOCUMENTS

GB 2320206 A * 6/1998

* cited by examiner

*Primary Examiner*—Raleigh W. Chiu
(74) *Attorney, Agent, or Firm*—Goldstein Law Office, P.C.

(57) ABSTRACT

A gaming unit having a pinball game and a casino game. Once a predetermined score is reached by playing the pinball game, the casino game is initiated. During the casino game, the player has the opportunity to win a monetary bonus. The pinball game continues, during which further opportunities to play the casino game will occur, until the pinball is lost from the playing field.

7 Claims, 3 Drawing Sheets

CASINO PINBALL GAME

BACKGROUND OF THE INVENTION

The invention relates to a casino pinball game. More particularly, the invention relates to a pinball game, which allows a pinball player to play a casino game once a predetermined pinball score is achieved.

Pinball is a game that requires considerable skill to master. An expert player can direct the pinball to any location on the game board in order to score points and of course, to avoid losing a turn. The reward for achieving such skill, however, is typically just personal satisfaction and "bragging rights".

Casino games, such as slot machines, however, require no skill to play, and the outcome is substantially random. On the other hand, however, there is potential for a payout that does not exist in a game such as pinball.

U.S. Pat. No. 6,358,146 to Adams, discloses a method of playing a gaming device that includes a primary gaming unit and a pinball type game. U.S. Pat. No. 5,785,594 to Seibert, Jr. et al. discloses a spinning wheel amusement device. U.S. Pat. No. 6,340,158 to Pierce et al. discloses a pachinko stand-alone and bonusing game.

While these units may be suitable for the particular purpose employed, or for general use, they would not be as suitable for the purposes of the present invention as disclosed hereafter.

SUMMARY OF THE INVENTION

It is an object of the invention to provide a game system that includes a pinball game and a casino game. Once a predetermined score is reached, the player has the opportunity to play the casino game.

It is another object of the invention to provide a casino game that adds a random element that enhances the score of the game. Accordingly, slot-machine type spinning reels or a roulette-type spinning wheel is employed to provide the player with the opportunity for a bonus score or a bonus payout.

The invention is a gaming unit having a pinball game and a casino game. Once a predetermined score is reached by playing the pinball game, the casino game is initiated. During the casino game, the player has the opportunity to win a monetary bonus. The pinball game continues, during which further opportunities to play the casino game will occur, until the pinball is lost from the playing field.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

The present invention is carried out using a gaming machine that includes a pinball game unit and a casino game unit.

Figure 1:
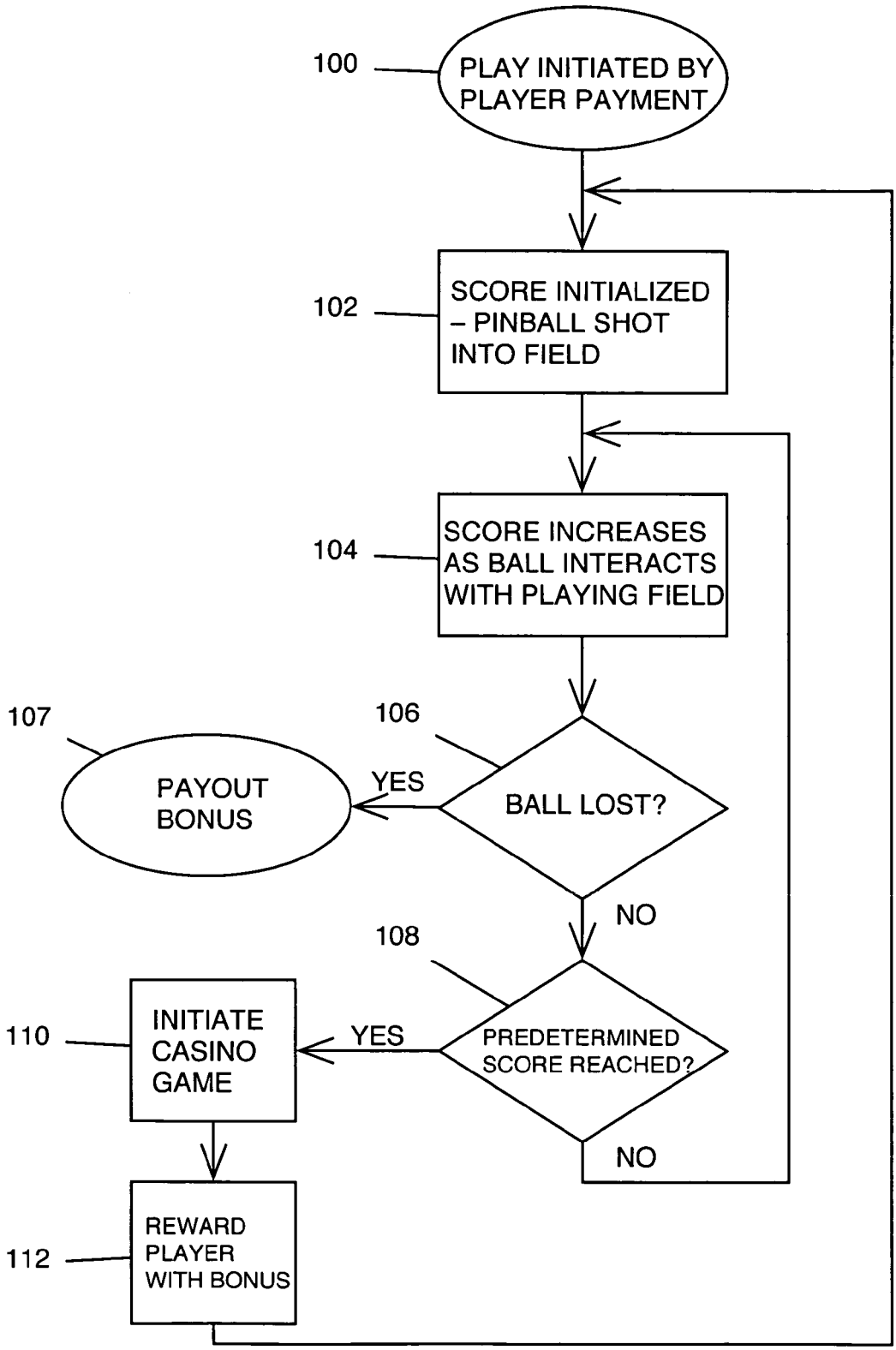
FIG. 1 is a flow diagram, illustrating the present invention.

FIG. 1 is a block diagram, illustrating overall game play according to the present invention. In particular, a player initiates play 100, typically by making a wager by depositing coins or a credit medium. Once play is initiated, the player has an initial score of zero, a pinball is tendered to the player, and is shot into the field 102. The pinball continues to interact with the playing field, such that the player score continues to increase 104 until the ball is lost 106. It should be noted that the game is described as though in its most basic form, wherein the game ends when the pinball is lost from the playing field. In accordance with traditional pinball machines, however, the player will likely be given several opportunities, and losses of the ball, before the game ends. As used herein then, the 'ball being lost from the playing field' means all available balls being lost from the playing field. Once the ball is lost from the playing field 106, a payout to the player of any bonus accrued is made 107.

According to the present invention, when a predetermined score is reached 108, a casino game is initiated 110, and the player is potentially rewarded with a monetary bonus 112 according to the outcome of the casino game. Then, the pinball continues to interact with the field, and the score continues to increase 104. Presented herein are two embodiments of the invention: each contemplating a different variation of the casino game.

According to a first embodiment of the invention, the casino game may be termed "jackpot pinball". In this embodiment, the gaming machine includes a vertical bar-graph display in the form of a stack of coins that symbolizes a dollar amount, and the casino game unit includes three slot machine reels. The slot machine reels each have several symbols depicted thereon, including a dollar sign.

Figure 2:
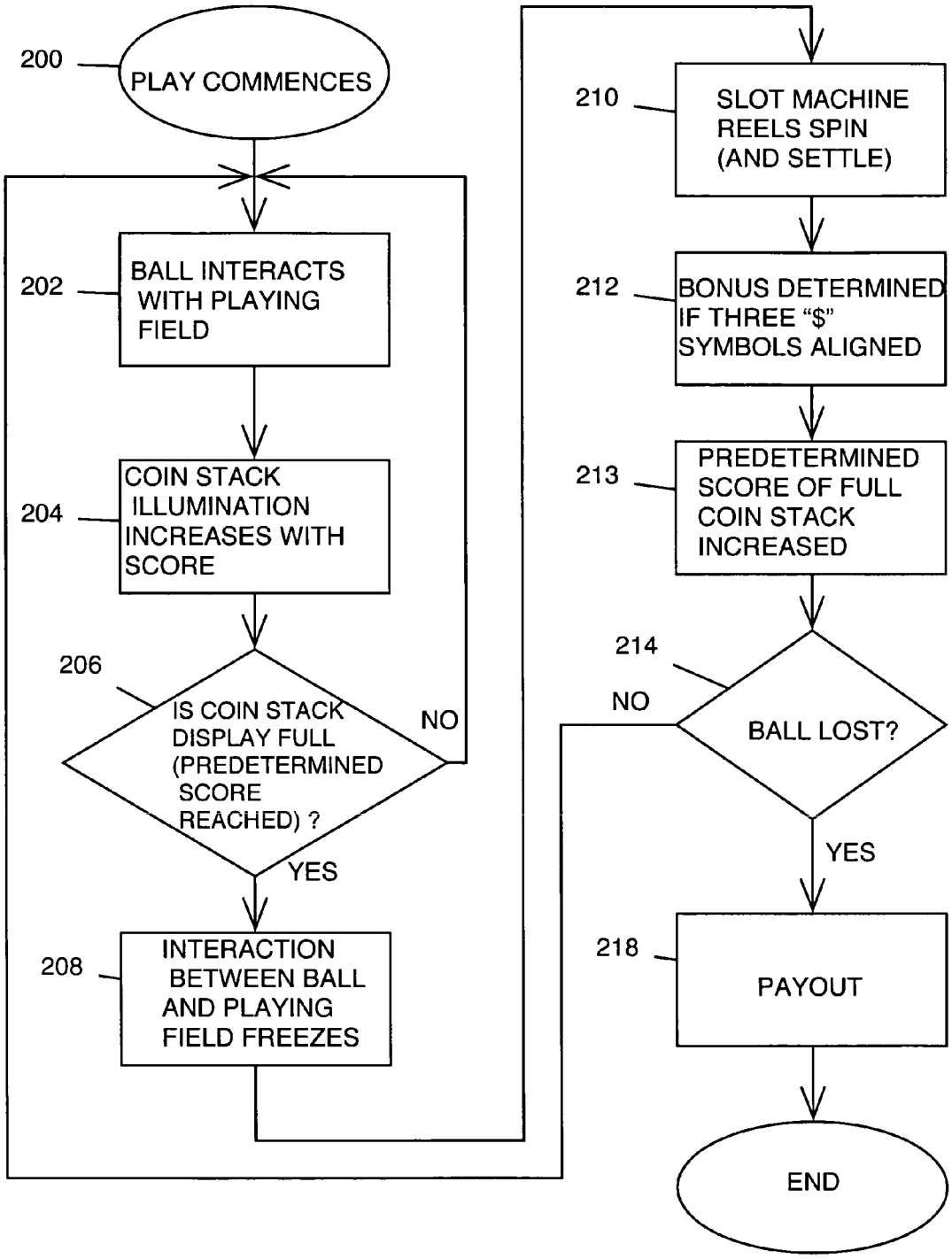
FIG. 2 is a flow diagram, illustrating a first embodiment of the invention.

Referring now to FIG. 2, in this first embodiment, game play commences 200, and the ball interacts with the playing field 202 to increase the score. According to this embodiment, however, as the score increases through interaction between the pinball playing field, the visual display of a coin stack increases 204. When the predetermined score is reached, the visual coin stack display is full 206. At this point, interaction between the ball and playing field will freeze 208, and the slot machine reels spin 210. When the slot machine reels once again settle, a match of the symbols displayed on the slot machine reels is used to determine a score bonus 212. In particular, it is contemplated that when three dollar signs are displayed, the player will earn a bonus equal to the dollar amount of the coin stack. Other symbol combinations may of course be given significance to enhance the player's interest in the game.

After the casino game is executed (210, 212), the pinball will continue interacting with the playing field 202. The predetermined monetary amount of the stack increases by increasing the predetermined score representing a full coin stack 213. Once again the coin stack increases with the score 204. At this point, however, the scale of the stack changes, with the setting of a new predetermined score at which both the stack is full and the casino game is initiated. Alternatively, several stacks may be depicted, each successive stack having a higher dollar amount. When one stack is full, it will remain full and then an adjacent stack will begin filling as the player score continues to increase. When that stack is full the casino game will be initiated to determine whether the player wins the dollar amount of that stack, and so on.

When the pinball is lost 214, a payout will be made to the player according to the score 216. Accordingly, the score achieved through interaction between the pinball and playing field along with any bonuses achieved through the casino game will determine the magnitude of the payout. Of course the magnitude of the payout can be determined by the wager made by the player, or any other suitable factors.

According to a second embodiment of the invention, the casino game may be termed "roulette pinball". In this embodiment, the gaming machine includes a simulated roulette wheel. The roulette wheel has a plurality of spaces that each have a dollar amount indicated thereon. The gaming machine also has a sign that includes the words "roulette pinball" which may be selectively illuminated.

Figure 3:
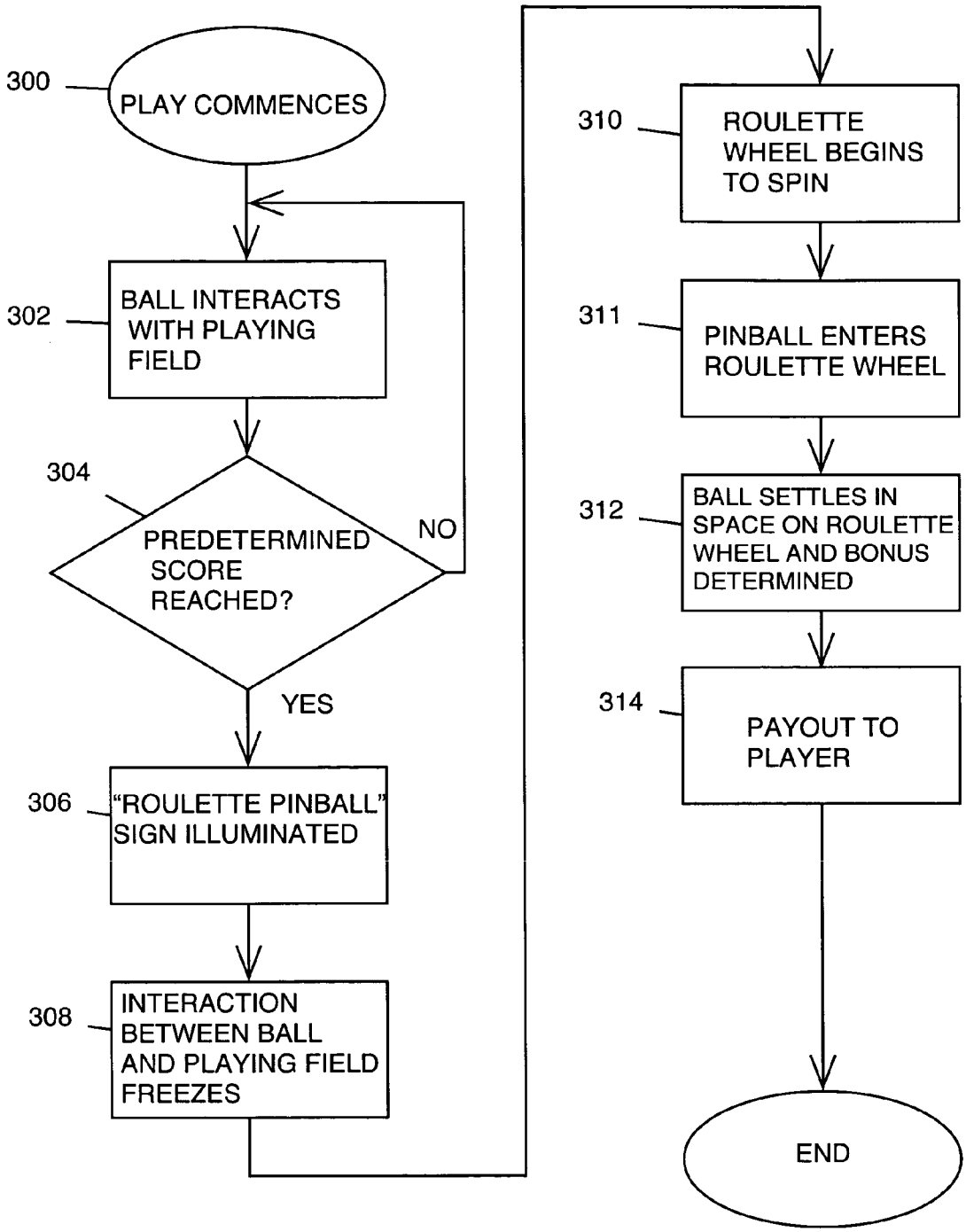
FIG. 3 is a flow diagram, illustrating a second embodiment of the invention.

Referring now to FIG. 3, in this second embodiment, game play commences 300, and the ball interacts with the playing field 302 to increase the score. When the predetermined score is reached 304, the words "roulette pinball" illuminate 306. At this point, interaction between the ball and playing field will freeze 308, and the roulette wheel begins to spin 310. The pinball enters the roulette wheel 311, and when the pinball settles in one of the spaces on the roulette wheel a payout bonus is determined by the dollar amount indicated on said space 312. An immediate payout of said bonus may be made to the player 314, or play may continue until the ball is lost as described in the previous embodiment.

In addition, when a payout is made, according to both embodiments of the invention, the payout need not refer to a currency payout. Electronic credits and tickets may also be used to make such a payout.

In conclusion, herein is presented a combined pinball and casino game unit. The invention is illustrated by example in the drawing figures, and throughout the written description. It should be understood that numerous variations are possible, while adhering to the inventive concept. Such variations are contemplated as being a part of the present invention.

What is claimed is:

1. A game method, using a game machine having a pinball unit and a casino unit, the casino unit is a roulette wheel having a plurality of spaces, each space having a predetermined dollar amount, operated by a player, comprising the steps of:

(a) initiating play by the player depositing a wager in the game machine;

(b) accumulating a score by the player by interacting the pinball with the playing field;

(c) initiating a casino game by the game machine when the score reaches a predetermined score by spinning the roulette wheel and introducing the pinball into the roulette wheel such that the pinball lands in one of the spaces and determines an outcome of the casino game by said space the pinball lands upon;

(d) rewarding the player with a monetary bonus according to the outcome of the casino game;

(e) continuing steps (b), (c), and (d) until the pinball is lost from the playing field; and (f) paying the player the monetary bonus.

2. The game method as recited in claim 1, wherein the pinball machine has a sign associated with the roulette wheel, and wherein the step of initiating the casino game further comprises illuminating said sign.

3. The game method as recited in claim 1, wherein the game unit further includes a display in the shape of a stack of coins that may be variably illuminated; wherein the stack of coins becomes more fully illuminated as the score increases; and wherein when the stack of coins is fully illuminated at the predetermined score at which the casino game is initiated.

4. The game method as recited in claim 3, wherein the casino game is a slot machine having three reels; wherein the step of initiating the casino game further comprises spinning the slot machine reels; and wherein the step of rewarding the player with a monetary bonus further comprises rewarding the player according to a combination of symbols that appear on the slot machine wheels.

5. The game method as recited in claim 4, wherein the stack of coins has a predetermined dollar amount, and wherein the step of rewarding the player with a monetary bonus further comprises rewarding the player with the predetermined dollar amount of the stack of coins.

6. The game method as recited 5, wherein after steps (c) and (d), the predetermined dollar amount of the stack of coins increases.

7. The game method as recited in claim 6, wherein the slot machine reels each contain a dollar symbol; and wherein when the combination of symbols on the slot machine reels is three dollar signs the player is rewarded the monetary bonus of the predetermined dollar amount of the stack of coins.

* * * * *